US006972277B2

(12) United States Patent
Dietz

(10) Patent No.: US 6,972,277 B2
(45) Date of Patent: Dec. 6, 2005

(54) FOAMING CLEAN AND POLISH EMULSIONS COMPRISING BISQUATERNARY ORGANOMODIFIED SILICONE

(75) Inventor: Thomas Dietz, Glen Allen, VA (US)

(73) Assignee: Goldschmidt GbmH, Essen (DE)

( * ) Notice: Subject to any disclaimer, the term of this patent is extended or adjusted under 35 U.S.C. 154(b) by 3 days.

(21) Appl. No.: 10/782,591

(22) Filed: Feb. 19, 2004

(65) Prior Publication Data

US 2005/0187121 A1 Aug. 25, 2005

(51) Int. Cl.[7] ..... C11D 9/36

(52) U.S. Cl. ..... 510/242; 510/205; 510/208; 510/213; 510/189; 510/241; 510/243; 510/244; 510/254; 510/268; 510/275; 510/466

(58) Field of Search ..... 510/205, 208, 510/213, 189, 241, 242, 243, 244, 254, 268, 510/466, 275

(56) References Cited

U.S. PATENT DOCUMENTS 5,409,640 A * 4/1995 Giret et al. ..... 510/417
5,830,483 A * 11/1998 Seidel et al. ..... 424/401
5,942,479 A * 8/1999 Frankenbach et al. ..... 510/159
6,696,052 B2 * 2/2004 Aeby et al. ..... 424/70.122

* cited by examiner

*Primary Examiner*—Charles Boyer
(74) *Attorney, Agent, or Firm*—Frommer Lawrence & Haug LLP

(57) ABSTRACT

This invention provides for, inter alia, a cleaning and polishing oil-in-water emulsion which comprises:

A. about 0.1 to about 25% of at least one silicone oil with a viscosity ranging between about 20 and about 100, 000 mPas.;

B. about 0.5 to about 25% of at least one bisquaternary organomodified silicone of the formula:

$$[Z—M—(R'R'')SiO—[(R'R'')SiO]_n—Si(R'R'')—M—Z]^{2+}2X^- \quad (I)$$

whereby

Z is a quaternary nitrogen radical,

R' and R" are independently from each other an alkyl or an aryl radical,

M is a divalent hydrocarbon radical having at least 4 carbon atoms which optionally contain at least one hydroxyl group and which may be interrupted by one or more oxygen atoms and/or groups of the type —C(O)—, —C(O)O— or —C(O)N—, n is a number between 1 and 200, $X^-$ is a inorganic or organic anion, C. about 0.1 to about 15.0% of at least one nonionic or amphoteric surfactant which has an alkyl chain length between 6 and 14 carbon atoms;

D. about 1 to about 40% of at least one oil selected from the group of mineral oils, paraffin oils, petroleum distillates, hydrocarbon solvents, ester oils, triglycerides and cyclic silicone oils;

E. about 0.1 to about 15% of at least one emulsifier;

F. about 20 to about 99% water; and optionally one or more auxiliaries selected from the group consisting of consistency enhancers, thickeners, stabilizers, fragrances, preservatives, antioxidants, dyes, abrasives, glycol ethers, alcohols, and builders. The inventive oil-in-water emulsion, when used in a non-pressurized foam dispenser, dispenses as a foam that is stable and dense. The inventive oil-in water emulsions may be used in cleaning and polishing surfaces.

17 Claims, 1 Drawing Sheet

FOAMING CLEAN AND POLISH EMULSIONS COMPRISING BISQUATERNARY ORGANOMODIFIED SILICONE

FIELD OF THE INVENTION

The present invention relates to clean and polish compositions applied from a foam pump dispenser. More particularly, the invention provides an aqueous composition comprising at least one short-chain surfactant, one quaternary silicone derivative and one silicone oil.

BACKGROUND OF THE INVENTION

Cleaning and polishing water-in-oil or oil-in-water emulsions are widely used in aerosol cans from which they are applied as a spray or a foam. Fields of application are hard surface care such as wood and furniture, stainless steel, vinyl and plastic, but also soft surfaces such as rubber and leather. The aerosol technology, however, has some disadvantages: the production of aluminum cans is highly energy consuming and thus expensive and environmentally stressing, aerosol cans are susceptible to corrosion, and some propellants used are environmentally unfriendly, because of depleting the ozone layer, or they are hazardous, because they are inflammable or explosive. Therefore there is a growing demand for propellant-free dispensing systems. Pump dispensers are a safe way for applying liquids on surfaces without the disadvantages described above. Pump dispensers have been developed capable of creating a foam by simply using the air compressed by mechanical labour caused by the stroke. Foaming emulsions are already introduced in the cosmetic market for skin care applications.

U.S. Pat. No. 5,683,972 discloses a foaming emulsion liquid composition comprising an aqueous phase comprising at least one high foaming anionic surfactant and at least one mild to the skin foaming surfactant selected from the group consisting of an anionic surfactant, amphoteric surfactant, nonionic surfactant, or mixture thereof. As examples of high foaming anionic surfactants long chain alkyl sulfates, long chain alkyl sulfonates, alkoxylated preferably ethoxylated materials thereof and the like are given. As examples of mild anionic surfactants long chain sulfosuccinates, sarcosinates and acylisethionates are given. Preferred examples of amphoteric surfactants are long chain amido alkyl betaines of about 8 to 20 carbon atoms such as cocamidopropylbetaine. As examples of foaming nonionic water soluble surfactants alkanolamides, amine oxides and alkylpolysaccharides are described. Preferred amine oxides are long chain alkyldimethylaminoxide and ethoxylated derivatives thereof.

WO 01/35904 discloses a foaming sunscreen preparation which is provided in the form of a foaming oil-in-water emulsion inside a foam dispenser, whereby the oil-in-water emulsion, with regard to the total composition, comprises 2–50 wt. % of an oil phase and 50–98 wt. % of a water phase that contains a surfactant. As preferred examples of foaming surfactants sodium cocoyl glutamate and cocamidopropyl betaine are given.

WO 03/088941 discloses a system comprising a foam dispenser which can be manually operated and a sun protecting emulsion. In the examples of foaming emulsions Disodium PEG-5 Laurylcitrate Sulfosuccinate, Sodium Laureth Sulfate and Capryl/Capramidopropyl Betaine are used as foaming surfactants, and Polyglyceryl-2 Dipolyhydroxystearate as emulsifier.

In home care, car care and industrial & institutional applications silicone oils are commonly used since they provide water repellency and gloss to various surfaces. Lower molecular weight silicone oils with a viscosity between 50 and 500 mPas are often combined with high molecular weight silicone oils with a viscosity between 1,000 and 100,000 mPas. The high viscosity silicone oils provide very high gloss, but are poor in spreadability, whereas the low viscosity silicone oils spread easily, but provide less gloss. Mixtures of both turned out to be superior in comparison to the single components. On the other hand, silicone oils are also well known as anti-foaming agents and are actually used for this purpose in skin care creams and lotions where they suppress the formation of micro-foam during rub-in on the skin which otherwise would cause the so-called whitening effect. In addition, silicone oils are known to be very emulsion stressing, i.e. causing water and oil separation.

The problem to be solved in the field of home care, car care and industrial & institutional applications was therefore to find cleaning and polishing emulsions containing substantial amounts of silicone oils which are also foaming from a pump dispenser. Surprisingly, it has been discovered that by combining silicone oils with a specific type of organomodified silicones and a specific type of organic surfactants, cleaning and polishing emulsions are obtained that provide excellent emulsion stability and foaming behavior from a pump dispenser while still containing a significant amount of silicone oil. The foaming emulsions provide excellent gloss properties derived from the silicone oil, anti-resoiling properties derived from the silicone quat and very good cleaning properties derived from the surfactant used to make the emulsion foam.

DESCRIPTION OF THE INVENTION

Figure 1:
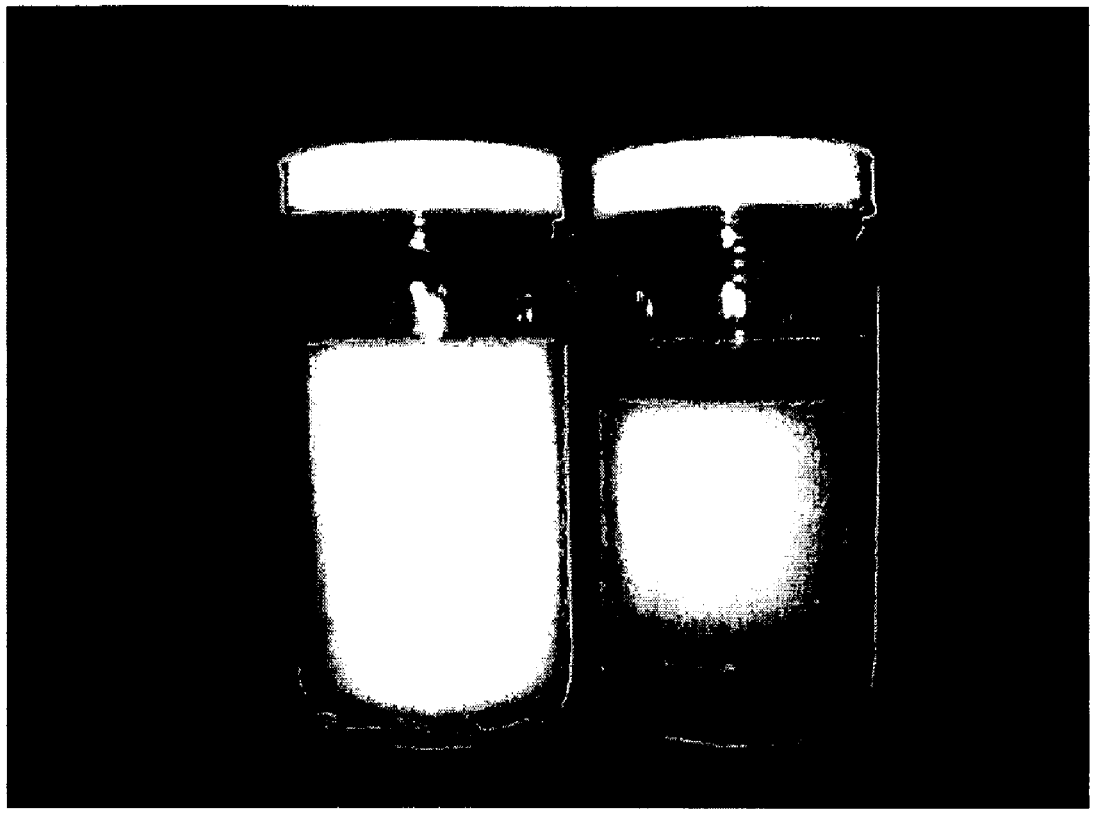
FIG. 1 is a picture depicting an emulsion prepared according to the present invention (left) with one known in the art (right).

The present invention provides for, inter alia, a cleaning and polishing oil-in-water emulsion that may be used, for example, in a dispenser such as a foam pump dispenser. Advantageously, the inventive oil-in-water emulsions exhibit excellent stability and remain as foams when dispensed. Moreover, when the inventive emulsions are used to clean and polish surfaces, they impart a high gloss and excellent anti-resoiling properties to the surfaces, while cleaning the surface in a good manner. Also contemplated are products which contain the inventive oil in water emulsions. These products include for example, car paint polishes, stainless steel polishes, leather polishes as well as furniture/wood polishes. More specifically, the present invention provides for a cleaning and polishing oil-in-water emulsion which comprises:

A. about 0.1 to about 25% of at least one silicone oil with a viscosity ranging between about 20 and about 100,000 mPas.;

B. about 0.5 to about 25% of at least one bisquaternary organomodified silicone of the formula:

$$[Z—M—(R'R'')SiO—[(R'R'')SiO]_n—Si(R'R'')—M—Z]^{2+}2\ X^- \quad (I)$$

whereby

Z is a quaternary nitrogen radical,

R' and R" are independently from each other an alkyl or an aryl radical,

M is a divalent hydrocarbon radical having at least 4 carbon atoms which optionally contain at least one hydroxyl group and which may be interrupted by one or more oxygen atoms and/or groups of the type —C(O)—, —C(O)O— or —C(O)N—, n is a number between 1 and 200, and $X^-$ is a inorganic or organic anion;

C. about 0.1 to about 15.0% of at least one nonionic or amphoteric surfactant which has an alkyl chain length between 6 and 14 carbon atoms;

D. about 1 to about 40% of at least one oil selected from the group of mineral oils, paraffin oils, petroleum distillates, hydrocarbon solvents, ester oils, triglycerides and cyclic silicone oils;

E. about 0.1 to about 15% of at least one emulsifier;

F. about 20 to about 99% water; and optionally one or more auxiliaries selected from the group consisting of consistency enhancers, thickeners, stabilizers, fragrances, preservatives, antioxidants, dyes, abrasives, glycol ethers, alcohols, and builders. Preferably, R' and R" in these emulsions are independently a $C_1$–$C_4$ alkyl radical or a $C_{11}$–$C_{18}$ alkyl radical.

Preferred cleaning and polishing oil-in-water emulsions are those wherein the bisquaternary organomodified silicone is a compound of the formula:

$$[Z—M—(CH_3)_2SiO—[(CH_3)_2SiO]_n—Si(CH_3)_2—M—Z]^{2+}2X^- \quad (II)$$

wherein

Z is the radical $—(R^1R^2R^3)N^+$ or $—(R^4R^5)N^+—(CH_2)_x—R^6—C(O)R^7$, $R^1$, $R^2$, $R^3$ independently from each other are $C_1$–$C_{22}$ $R^4$, $R^5$, and alkyl or $C_2$–$C_{22}$ alkenyl radicals optionally substituted by $R^7$ one more OH groups or a $—CH_2$-aryl radical, x is number between 2 and 6, $R^6$ is an oxygen atom or a group $—N(R^8)$, wherein $R^8$ is hydrogen, a $C_1$–$C_4$ alkyl or hydroxyalkyl radical, M is a divalent hydrocarbon radical with at least 4 carbon atoms, which is optionally substituted with at least one hydroxyl group and which may be interrupted by one or more oxygen atoms and/or at least one radical selected from the group consisting of —C(O)—, —C(O)O— and —C(O)N—, n is a number between 8 and 200, and $X^-$ is an inorganic or organic anion, Preferred emulsions are those wherein at least one of the variables of the $R^1$, $R^2$ or $R^3$ is an alkyl radical having at least 10 carbon atoms or a benzyl radical.

Other preferred emulsions are those wherein the bisquaternary organomodified silicone is a compound of the formula:

$$[Z—M—(CH_3)_2SiO—[(CH_3)_2SiO]_n—Si(CH_3)_2—M—Z]^{2+}2X^- \quad (II)$$

wherein

Z is the radical $—(CH_3)_2N^+—(CH_2)_x—R^6—C(O)R^7$, $R^7$ is a $C_{16}$–$C_{22}$ alkyl radical or a $C_{16}$–$C_{22}$ alkylene radical, each of which is optionally substituted with one or more hydroxyl groups, x is number between 2 and 6, $R^6$ is an oxygen atom or a group $—N(R^8)$, wherein $R^8$ is hydrogen, a $C_1$–$C_4$ alkyl radical or a $C_1$–$C_4$ hydroxyalkyl radical, M is a divalent hydrocarbon radical with at least 4 carbon atoms, which optionally contain at least one hydroxyl group and which is optionally interrupted by one or more oxygen atoms and/or at least one radical selected from the group consisting of —C(O)—, —C(O)O— and —C(O)N—, n is a number between 8 and 100, and $X^-$ is an inorganic or organic anion.

Those emulsions wherein $X^-$ is an acetate ion are especially preferred.

Other especially preferred cleaning and polishing oil-in-water emulsions are those which comprise:

A. about 0.5 to about 10% of at least one silicone oil with a viscosity ranging between about 50 and 50,000 mPas.;

B. about 0.5 to about 10% of at least one bisquaternary organomodified silicone;

C. about 0.5 to about 10% of at least one nonionic or amphoteric surfactant having an alkyl chain length between 8 and 12 carbon atoms;

D. about 5 to about 20% of at least one oil selected from the group consisting of mineral oil, a hydrocarbon solvent, an ester oil, and a cyclopentasiloxane;

E. about 0.5 to about 10% of an emulsifier which is a nonionic surfactants; and

F. about 60% to about 90% water, or those which contain:

A. about 1 to about 5% of at least one silicone oil with a viscosity ranging between about 100 and 20,000 mPas.;

B. about 1% to about 5% of at least one bisquaternary organomodified silicone;

C. about 2% to about 8% of at least one surfactant, wherein the surfactant is selected from the group consisting of ethylhexyl (poly)glucoside, capryl/caprylyl (poly)glucoside, decamine oxide, capryl/capramidopropyl betaine, undecylenamidopropyl betaine and sodium caprylamphopropionate;

D. about 5% to about 15% of at least one oil which is selected from the group consisting of a mineral oil, a hydrocarbon solvent, an ester oil, and a cyclopentasiloxane;

E. about 1% to about 7% of a nonionic emulsifier; and

F. about 70% to about 90% water.

Another especially preferred oil-in-water emulsion is one wherein

A. about 1% to about 5% of at least one silicone oil with a viscosity ranging between about 100 and 20,000 mPas;

B. about 1% to about 5% of at least one bisquaternary organomodified siloxane;

C. about 2% to about 4% of at least one surfactant selected from the group consisting of ethylhexyl(poly)glucoside, capryl/caprylyl (poly)glucoside, and decamine oxide;

D. about 5% to about 15% of at least one oil which is selected from the group consisting of a mineral oil, a hydrocarbon solvent, cyclopentasiloxane and a mixture of the foregoing;

E. about 1 to about 5% of an emulsifier selected form the group consisting of sorbitan esters, ethoxylated sorbitan esters and a mixture of the foregoing; and F. about 75% to 90% water. This invention further provides for a method for the preparation of the inventive cleaning and polishing oil-in-water emulsions, which comprises:

1. producing an emulsion by homogenizing a mixture of components A, B, D and E with component F, and
2. adding component C to the emulsion obtained above, optionally with a part of water of F and/or with preservative and/or other auxiliaries. Also provided for in the present invention is a pump dispenser which comprises a cleaning and polishing emulsion according to the present invention as well as a method for cleaning and polishing a surface which comprises applying a portion of foam from the dispenser and wiping the surface with a cloth or towel.

In describing invention, the term "oil-in-water" ("O/W") emulsions been employed in order to distinguish the inventive compositions from water-in-oil ("W/O") emulsions. The art recognizes O/W emulsions to be physically distinct from W/O emulsions. Both types of emulsions exhibit different physical properties and will remain in that state unless the HLB value is affected through physical action.

Preferred, non-limiting organic surfactants which may be included in the inventive emulsions are:

nonionic surfactants with an alkyl chain length between 6 and 14 carbon atoms, such as encompassing alkyl glucosides such as 2-ethylhexyl glucoside, caprylyl/capryl glucoside, and aminoxides, such as decamine oxide and dodecamine oxide;

Amphoteric surfactants, especially betaines such as N-alkyl-N,N-dimethylammonium glycinates, N-acylaminopropyl-N,N-dimethylammonium glycinates, for example capryl/capramidopropyl betaine and undecyleneamidopropyl betaine, and 2-alkyl-3-carboxymethyl-3-hydroxyethylimidazolinesu having in each case 6 to 14 carbon atoms in the alkyl or acyl group. Other suitable surfactants include those which, apart from a $C_6$–$C_{14}$-alkyl or -acyl group in the molecule, contain at least one free amino group and at least one —COOH or —$SO_3H$ group and are capable of forming internal salts. Examples of suitable surfactants are N-alkylglycines, N-alkylpropionic acids, N-alkylaminobutyric acids, N-alkyliminodipropionic acids, N-hydroxyethyl-N-alkylamidopropylglycinesu, N-alkyltaurines, N-alkylsarcosines, 2-alkylaminopropionic acids and alkylaminoacetic acids having in each case about 6 to 14 carbon atoms. Examples are N-alkylaminopropionate, acylaminoethylaminopropionate and $C_6$–$C_{14}$-acylsarcosine; and Anionic surfactants with an alkyl chain length between 6 and 14 carbon atoms, encompassing sulfosuccinates such as sodium dioctyl aulfosuccinate.

Suitable emulsifiers are, for example, nonionic or anionic surfactants from at least one of the following groups:

addition products of from 2 to 30 mol of ethylene oxide and/or 0 to 5 mol of propylene oxide onto linear fatty alcohols or fatty amines having 8 to 22 carbon atoms, onto fatty acids having 12 to 22 carbon atoms and onto alkylphenols having 8 to 15 carbon atoms in the alkyl group;

$C_{12/18}$-fatty acid mono- and diesters of addition products of from 1 to 30 mol of ethylene oxide onto glycerol;

glycerol mono- and diesters and sorbitan mono- and diesters of saturated and unsaturated fatty acids having 6 to 22 carbon atoms and ethylene oxide addition products thereof;

alkyl mono- and oligoglycosides having 8 to 22 carbon atoms in the alkyl radical and ethoxylated analogs thereof;

addition products of 15 to 60 mol of ethylene oxide onto castor oil and/or hydrogenated castor oil;

polyol, and in particular polyglycerol, esters, such as, for example, polyglycerol polyricinoleate, polyglycerol 12-hydroxystearate or polyglycerol dimerate. Likewise suitable are mixtures of compounds from two or more of these classes of substance;

addition products of from 2 to 15 mol of ethylene oxide onto castor oil and/or hydrogenated castor oil;

partial esters based on linear, branched, unsaturated or saturated $C_{6/22}$-fatty acids, ricinoleic acid, and 12-hydroxystearic acid and glycerol, polyglycerol, pentaerythritol, dipentaerythritol, sugar alcohols (for example sorbitol), alkyl glucosides (for example methyl glucoside, butyl glucoside, lauryl glucoside), and polyglucosides (for example cellulose);

mono-, di- and trialkyl phosphates, and mono-, di- and/or tri-PEG alkyl phosphates;

polysiloxane-polyether copolymers and corresponding derivatives; and polyalkylene glycols.

The addition products of ethylene oxide and/or propylene oxide onto fatty alcohols, fatty acids, alkylphenols, glycerol mono- and diesters, and sorbitan mono- and diesters of fatty acids or onto castor oil are known, commercially available products. These are homolog mixtures whose average degree of alkoxylation corresponds to the ratio of the material amounts of ethylene oxide and/or propylene oxide and substrate with which the addition reaction is carried out.

Suitable silicone quats are, for example, products commercially available from Goldschmidt Chemical Corporation, Hopewell Va., under the tradenames TEGOPREN 6920, 6922, 6924 and TEGO Polish Additiv Q 70. These are linear alpha, omega-quaternary modified silicones bearing alkyl dimethyl ammonium groups attached at both ends via an organic spacer to the silicone chain. The silicone chain length varies between 10 and 80 dimethylsiloxane units. Depending on the silicone chain length these compounds are more water or oil soluble. Due to the quaternary groups they exhibit high affinity to surfaces, anti-static, anti-redeposition and anti-resoiling effects.

Suitable oil components are, for example, mineral oils and hydrocarbon solvents including isoparaffinic hydrocarbons. Others are low odor petroleum solvents, kerosene, pine oil, naphthenic and d-limonene. Silicone oils are herein not considered as oil components, but as gloss and water repellency providing active ingredients, except the low molecular weight and solvent-like cyclic silicone oils, in particular cyclopentasiloxane. Besides hydrocarbon solvents, oil components can be used which are also used as cosmetic and pharmaceutic oil components as well as lubricants. Examples are mono or diester of linear and/or branched mono or dicarbonic acids with 2 to 44 carbon atoms with linear and/or branched saturated or unsaturated alcohols with 1 to 22 carbon atoms. Examples are methyl laurate, isopropyl myristate, isopropyl palmitate, ethylhexyl palmitate, $C_{12-15}$ alkylbenzoate, dibutyl adipate. Likewise esterification products of aliphatic, bifunctinal alcohols with 2 to 36 carbon atoms with monofunctional aliphatic carbonic acids with 1 to 22 carbon atoms can be used. Examples are ethylene glycol dioleate, propylene glycol diethylhexanoate, mineral oils, ester oils as well as cyclic silicone oils can be used. Also suitable are synthetic or natural triglycerides, e.g. caprylic/capric triglyceride, rapeseed oil and sufflower oil.

Suitable silicone oils are polydimethylsiloxanes generally described with the following formula:

$$(CH_3)_3SiO—[(CH_3)_2SiO]_m—Si(CH_3)_3$$

whereby the viscosity may vary between about 20 and about 100,000 mPas.

The present invention is more particularly described in the following examples, which is intended as illustrative only, since numerous modifications and variations therein will be apparent to one skilled in the art.

EXAMPLE 1

Emulsions No. 1–3 are referred to the present invention, whereas emulsions No. 4–6 are given for comparison.

TABLE 1

| | Emulsion No. | | | | | |
|---|---|---|---|---|---|---|
| | 1 % | 2 % | 3 % | 4 % | 5 % | 6 % |
| Phase A | | | | | | |
| TEGO SMO (Sorbitan Monooleate) | 1.85 | 1.85 | 1.85 | 1.85 | 1.85 | 1.85 |
| TEGO SML 20 (PEG-20 Sorbitan Monolaurate) | 1.15 | 1.15 | 1.15 | 1.15 | 1.15 | 1.15 |
| Drakeol 5 LT (Mineral Oil) | 12.0 | 12.0 | 12.0 | 12.0 | 12.0 | 12.0 |
| ABIL 350 (Silicone Oil, 350 mPas) | 1.5 | 1.5 | 1.5 | 1.5 | — | 1.5 |
| Rhodasil 10,000 (Silicone Oil, 10,000 mPas) | 0.5 | 0.5 | 0.5 | 0.5 | — | 0.5 |
| TEGO Polish Additiv Q 70 | 2.0 | — | — | — | — | — |
| TEGOPREN 6924 | | 2.0 | — | — | — | — |
| TEGOPREN 6922 | | — | 2.0 | — | — | — |
| Phase B | | | | | | |
| Water | 66.0 | 66.0 | 66.0 | 68.0 | 58.5 | 61.4 |
| TEGO Polish Additiv E 35 (silicone oil emulsion 30%, silicone oil viscosity 350 mPas) | — | — | — | — | 8.6 | — |
| TEGO Polish Additiv EZ (silicone oil emulsion 30%, silicone oil viscosity 10,000 mPas) | — | — | — | — | 2.9 | — |
| TEGOPREN 6950 (Silicone betaine, 30% active matter) | — | — | — | — | — | 6.6 |
| Phase C | | | | | | |
| TEGOTENS DO (Decamine oxide) | 6.0 | 6.0 | 6.0 | 6.0 | 6.0 | 6.0 |
| Phenonip | 0.5 | 0.5 | 0.5 | 0.5 | 0.5 | 0.5 |
| Water | 8.5 | 8.5 | 8.5 | 8.5 | 8.5 | 8.5 |
| Emulsion stability | + | + | + | − | − | − |
| Foaming behavior | +/+/+ | +/+/+ | +/+/+ | −/−/− | −/−/− | −/−/− |

Preparation: Components of phase A are combined and stirred until homogeneous. Phase B is added to phase A and homogenized for 2 min. Components of phase C are combined and stirred until clear. Then phase C is added to the emulsion (A+B) while slightly stirring.

Emulsion stability testing: The emulsions were stored at room temperature and checked visually for creaming and separation after two weeks. + means no or little creaming which is reversible by simply stirring, − means irreversible oil and water separation.

FIG. 1 shows emulsion No. 1 (on the left) in comparison to emulsion No. 4 (on the right).

Foaming behavior: The emulsions were transferred into a foam pump dispenser (F 2 pump foamer, output 0.8 ml/stroke, 100 ml HDPE natural, Airspray International B. V., Alkmaar/NL). After shaking the dispenser it was pumped until foam came out of the dispenser. With one single stroke a portion of foam was put onto a surface and the amount (+ much, − little), structure (+ fine, − coarse) and stability (+stable, −unstable) was evaluated. For example, +/+/+ means much foam, fine structure and stable foam, whereas −/−/− means little foam, coarse structure and unstable foam.

The results given in Table 1 show that only the combination of a silicone quat with silicone oils results in stable and foaming emulsions. Emulsions without the silicone quat are unstable (emulsion No. 4). The same is true for emulsions containing pre-emulsified silicone oils in form of silicone emulsions (emulsion No. 5), but no silicone quat. Emulsion No. 6 demonstrates that other types of silicone derivatives, e.g. silicone betaines, do not provide the stability and foaming behavior as silicone quats do.

EXAMPLE 2

Foaming clean and polish emulsion for stainless steel

| | % |
|---|---|
| Phase A | |
| Varonic K 202 (PEG-2 Cocamine) | 1.67 |
| Varonic K 205 (PEG-5 Cocamine) | 2.33 |
| Shellsol OMS (aromatic-free hydrocarbon solvent) | 10.0 |
| ABIL 100 (silicone oil, 100 mPas) | 1.0 |
| TEGO Polish Additiv Q 70 (silicone quat) | 1.0 |
| Phase B | |
| Water | 78.0 |
| Phase C | |
| TEGO Betain 810 (Capryl/Capramidopropyl Betaine) | 6.0 |

Preparation:

Components of phase A are combined and stirred until homogeneous. Phase B is added to phase A and homogenized for two minutes. Phase C is added to emulsion (A+B) while slightly stirring.

EXAMPLE 3

Polish emulsion for leather care

| | % |
|---|---|
| Phase A | |
| TEGINACID H (Glyceryl Stearate (and) Ceteth-20) | 3.0 |
| TEGO Alkanol 1618 (Cetearyl Alcohol) | 0.5 |
| Drakeol 5 LT (Mineral Oil) | 6.0 |

-continued

| | % |
|---|---|
| ABIL 350 (silicone oil, 350 mPas) | 2.0 |
| TEGOPREN 6922 (silicone quat) | 2.0 |
| Phase B | |
| Water | 71.5 |
| Phase C | |
| TEGOTENS DO (Decamine Oxide) | 6.0 |
| Phenonip | 0.5 |
| Water | 8.5 |

Preparation:

Components of phase A are heated to 80° C. until completely melted. Phase B is heated to 80° C., added to phase A and homogenized for two minutes. The emulsion is cooled down slowly while slightly stirring, then Phase C is added while slightly stirring.

EXAMPLE 4

Polish for furniture care with excellent gloss and anti-resoiling/anti-redeposition properties

| | % |
|---|---|
| Phase A | |
| TEGO SMO (Sorbitan Monooleate) | 1.85 |
| TEGO SML 20 (PEG-20 Sorbitan Monolaurate) | 1.15 |
| Drakeol 5 LT (Mineral Oil) | 7.5 |
| TEGO Polish Additiv 5 (Cyclopentasiloxane) | 4.5 |
| ABIL 350 (Silicone Oil, 350 mPas) | 1.5 |
| Rhodasil 10,000 (Silicone Oil, 10,000 mPas) | 0.5 |
| TEGO Polish Additiv Q 70 (silicone quat) | 2.0 |
| Phase B | |
| Water | 66.0 |
| Phase C | |
| TEGOTENS DO (Decamine oxide) | 6.0 |
| Phenonip | 0.5 |
| Water | 8.5 |

Preparation:

Components of phase A are combined and stirred until homogeneous. Phase B is added to phase A and homogenized for two minutes. Phase C is added to emulsion (A+B) while slightly stirring.

EXAMPLE 5

Polish for exterior car polish and vinyl

| | % |
|---|---|
| Phase A | |
| TEGO SMO (Sorbitan Monooleate) | 1.85 |
| TEGO SML 20 (PEG-20 Sorbitan Monolaurate) | 1.15 |
| Drakeol 5 LT (Mineral Oil) | 12.0 |
| ABIL 350 (Silicone Oil, 350 mPas) | 1.5 |
| Rhodasil 10,000 (Silicone Oil, 10,000 mPas) | 0.5 |
| TEGO Polish Additiv Q 70 (silicone quat) | 2.0 |
| Phase B | |
| Water | 66.0 |
| Phase C | |
| TEGOTENS G 826 (Ethylhexyl Glucoside) | 6.0 |
| Phenonip | 0.5 |
| Water | 8.5 |

Preparation:

Components of phase A are combined and stirred until homogeneous. Phase B is added to phase A and homogenized for two minutes. Phase C is added to emulsion (A+B) while slightly stirring.

The above description of the invention is intended to be illustrative and not limiting. Various changes or modifications in the embodiments described herein may occur to those skilled in the art. These changes can be made without departing from the scope or spirit of the invention.

What is claimed is:

1. A cleaning and polishing oil-in-water emulsion which comprises:

A. about 0.1 to about 25% of at least one silicone oil with a viscosity ranging between about 20 and about 100,000 mPas.;

B. about 0.5 to about 25% of at least one bisquaternary organomodified silicone of the formula:

$$[Z—M—(R'R'')SiO—[(R'R'')SiO]_n—Si(R'R'')—M—Z]^{2+}2X^- \quad (I)$$

whereby

Z is a quaternary nitrogen radical,

R' and R" are independently from each other an alkyl or an aryl radical,

M is a divalent hydrocarbon radical having at least 4 carbon atoms which optionally contain at least one hydroxyl group and which may be interrupted by one or more oxygen atoms and/or groups of the type —C(O)—, —C(O)O— or —C(O)N—, n is a number between 1 and 200, $X^-$ is an inorganic or organic anion;

C. about 0.1 to about 15.0% of at least one nonionic or amphoteric surfactant which has an alkyl chain length between 6 and 14 carbon atoms;

D. about 1 to about 40% of at least one oil selected from the group of mineral oils, paraffin oils, petroleum distillates, hydrocarbon solvents, ester oils, triglycerides and cyclic silicone oils;

E. about 0.1 to about 15% of at least one emulsifier;

F. about 20 to about 99% water; and optionally one or more auxiliaries selected from the group consisting of consistency enhancers, thickeners, stabilizers, fragrances, preservatives, antioxidants, dyes, abrasives, glycol ethers, alcohols, and builders.

2. The cleaning and polishing oil-in-water emulsion according to claim 1, wherein R' and R" are independently a $C_1$–$C_4$ alkyl radical or a $C_{11}$–$C_{18}$ alkyl radical.

3. The cleaning and polishing oil-in-water emulsion according to claim 1, wherein the bisquaternary organomodified silicone is a compound of the formula:

$$[Z—M—(CH_3)_2SiO—[(CH_3)_2SiO]_n—Si(CH_3)—M—Z]^{2+}2X^- \quad (II)$$

wherein

Z is the radical $—(R^1R^2R^3)N^+$ or $—R^4R^5)N^+—(CH_2)_x—R^6—C(O)R^7$, $R^1$, $R^2$, $R^3$ independently from each other are $C_1$–$C_{22}$ $R^4$, $R^5$, and alkyl or $C_2$–$C_{22}$ alkenyl radicals optionally substituted by $R^7$ one more OH groups or a $—CH_2$-aryl radical, x is number between 2 and 6, $R^6$ is an oxygen atom or a group $—N(R^8)$, wherein $R^8$ is hydrogen, a $C_1$–$C_4$ alkyl or hydroxyalkyl radical, M is a divalent hydrocarbon radical with at least 4 carbon atoms, which is optionally substituted with at least one hydroxyl group and which may be interrupted by one or more oxygen atoms and/or at least one radical selected from the group consisting of —C(O)—, —C(O)O— and —C(O)N—, n is a number between 8 and 200, and $X^-$ is an inorganic or organic anion.

4. The cleaning and polishing oil-in-water emulsion according to claim 1, wherein at least one of the variables of the $R^1$, $R^2$ or $R^3$ is an alkyl radical having at least 10 carbon atoms or a benzyl radical.

5. The cleaning and polishing oil-in-water emulsion according to claim 1, wherein the bisquaternary organomodified silicone is a compound of the formula:

$$[Z—M—(CH_3)_2SiO—[(CH_3)_2SiO]_n—Si(CH_3)_2—M—Z]^{2+}2X^- \quad (III)$$

wherein

Z is the radical $—(CH_3)_2N^+—(CH_2)_x—R^6—C(O)R^7$, $R^7$ is a $C_{16}$–$C_{22}$ alkyl radical or a $C_{16}$–$C_{22}$ alkylene radical, each of which is optionally substituted with one or more hydroxyl groups, x is number between 2 and 6, $R^6$ is an oxygen atom or a group $—N(R^8)$, wherein $R^8$ is hydrogen, a $C_1$–$C_4$ alkyl radical or a $C_1$–$C_4$ hydroxyalkyl radical, M is a divalent hydrocarbon radical with at least 4 carbon atoms, which optionally contain at least one hydroxyl group and which is optionally interrupted by one or more oxygen atoms and/or at least one radical selected from the group consisting of —C(O)—, —C(O)O— and —C(O)N—, n is a number between 8 and 100, and $X^-$ is an inorganic or organic anion.

6. The cleaning and polishing emulsion according to claim 5, wherein $X^-$ is an acetate ion.

7. The cleaning and polishing oil-in-water emulsion according to claim 1, which comprises A. about 0.5 to about 10% of at least one silicone oil with a viscosity ranging between about 50 and 50,000 mPas.;

B. about 0.5 to about 10% of at least one bisquaternary organomodified silicone;

C. about 0.5 to about 10% of at least one nonionic or amphoteric surfactants having an alkyl chain length between 8 and 12 carbon atoms;

D. about 5 to about 20% of at least one oil selected from the group consisting of mineral oil, a hydrocarbon solvent, an ester oil, and a cyclopentasiloxane;

E. about 0.5 to about 10% of an emulsifier which is a nonionic surfactants; and

F. about 60% to about 90% water.

8. The cleaning and polishing oil-in-water emulsion according to claim 1, wherein A. about 1 to about 5% of at least one silicone oil with a viscosity ranging between about 100 and 20,000 mPas.;

B. about 1% to about 5% of at least one bisquaternary organomodified silicone;

C. about 2% to about 8% of at least one surfactant, wherein the surfactant is selected from the group consisting of ethylhexyl (poly)glucoside, capryl/caprylyl (poly)glucoside, decamine oxide, capryl/capramidopropyl betaine, undecylenamidopropyl betaine and sodium caprylamphopropionate;

D. about 5% to about 15% of at least one oil which is selected from the group consisting of a mineral oil, a hydrocarbon solvent, an ester oil, and a cyclopentasiloxane;

E. about 1% to about 7% of a nonionic emulsifier; and

F. about 70% to about 90% water.

9. A cleaning and polishing oil-in-water emulsion according to claim 1, wherein

A. about 1% to about 5% of at least one silicone oil with a viscosity ranging between about 100 and 20,000 mPas;

B. about 1% to about 5% of at least one bisquaternary organomodified siloxanes;

C. about 2% to about 4% of at least one surfactant selected from the group consisting of ethylhexyl(poly)glucoside, capryl/caprylyl (poly)glucoside, and decamine oxide;

D. about 5% to about 15% of at least one oil which is selected from the group consisting of a mineral oil, a hydrocarbon solvent, cyclopentasiloxane and a mixture of the foregoing;

E. about 1 to about 5% of an emulsifier selected form the group consisting of sorbitan esters, ethoxylated sorbitan esters and a mixture of the foregoing; and F. about 75% to 90% water.

10. A method for the preparation of a cleaning and polishing oil-in-water emulsion according to claim 1, which comprises:

1. producing an emulsion by homogenizing a mixture of components A, B, D and E with component F, and 2. adding component C to the emulsion obtained above, optionally with a part of water of F and/or with a preservative and/or other auxiliaries.

11. A pump dispenser which includes a cleaning and polishing emulsion according to claim 1.

12. The pump dispenser according to claim 11, which is a non-pressurized foam pump dispenser.

13. A method for cleaning and polishing a surface which comprises applying a portion of foam from the dispenser according to claim 11 and wiping the surface with a cloth or towel.

14. A polish which comprise the oil-in-water emulsion according to claim 1.

15. The polish according to claim 14, which is a furniture/wood polish or a car paint polish.

16. The polish according to claim 14, which is a stainless steel polish or a plastic polish.

17. The polish according to claim 14, which is a leather polish.

* * * * *